US010975763B2

(12) United States Patent
Ichihara et al.

(10) Patent No.: US 10,975,763 B2
(45) Date of Patent: Apr. 13, 2021

(54) VARIABLE-COMPRESSION-RATIO INTERNAL COMBUSTION ENGINE

(71) Applicants: Nissan Motor Co., Ltd., Yokohama (JP); Renault S.A.S., Boulogne-Billancourt (FR)

(72) Inventors: Hiroki Ichihara, Kanagawa (JP); Hidehiro Fujita, Kanagawa (JP); Satoru Ookuma, Kanagawa (JP)

(73) Assignees: Nissan Motor Co., Ltd., Yokohama (JP); Renault S.A.S., Boulogne-Billancourt (FR)

( * ) Notice: Subject to any disclaimer, the term of this patent is extended or adjusted under 35 U.S.C. 154(b) by 0 days.

(21) Appl. No.: 16/977,839

(22) PCT Filed: Mar. 6, 2018

(86) PCT No.: PCT/IB2018/000343
§ 371 (c)(1),
(2) Date: Sep. 3, 2020

(87) PCT Pub. No.: WO2019/171098
PCT Pub. Date: Sep. 12, 2019

(65) Prior Publication Data

US 2021/0010416 A1 Jan. 14, 2021

(51) Int. Cl.
*F02B 75/04* (2006.01)
*F02D 15/02* (2006.01)
(Continued)

(52) U.S. Cl.
CPC ..... *F02B 75/041* (2013.01); *F02D 13/0269* (2013.01); *F02D 15/02* (2013.01);
(Continued)

(58) Field of Classification Search
CPC .. F02B 75/041; F02B 2075/025; F02D 15/02; F02D 15/04; F02D 13/0269; F02F 7/0002; F02F 7/0021; F02F 7/0095
See application file for complete search history.

(56) References Cited

U.S. PATENT DOCUMENTS 8,726,858 B2 * 5/2014 Hiyoshi ..... F02B 75/048 123/48 R
9,863,311 B2 * 1/2018 Hiyoshi ..... F02B 75/045
(Continued)

FOREIGN PATENT DOCUMENTS

CN 103946515 A 7/2014
CN 105074165 A 11/2015
(Continued)

*Primary Examiner* — Syed O Hasan
(74) *Attorney, Agent, or Firm* — Global IP Counselors, LLP

(57) ABSTRACT

An upper oil pan assembly is attached to the lower portion of a cylinder block. An opening is formed on a side wall of the upper oil pan assembly. The variable compression ratio mechanism changes a top dead center position of a piston in accordance with the rotational position of a control shaft to thereby change the compression ratio. The control shaft is rotationally driven by an actuator. At least a portion of the actuator is fixed to a main bearing cap in a state in which at least a portion thereof is positioned on the outer side of an upper oil pan assembly.

15 Claims, 6 Drawing Sheets

(51) Int. Cl.

| | |
|---|---|
| ***F02F 7/00*** | (2006.01) |
| ***F02D 15/04*** | (2006.01) |
| ***F02D 13/02*** | (2006.01) |

(52) U.S. Cl.
CPC ..... *F02D 15/04* (2013.01); *F02F 7/0002* (2013.01); *F02F 7/0021* (2013.01); *F02F 7/0095* (2013.01)

(56) References Cited

U.S. PATENT DOCUMENTS

| | | | | |
|---|---|---|---|---|
| 10,054,064 | B2 | 8/2018 | Tanaka et al. | |
| 2015/0176507 | A1* | 6/2015 | Tanaka ..... | F02F 7/0068 123/48 R |

FOREIGN PATENT DOCUMENTS

| | | | |
|---|---|---|---|
| DE | 10 2015 201 804 | A1 | 8/2015 |
| EP | 2 063 086 | A1 | 5/2009 |
| EP | 2 787 196 | A1 | 10/2014 |
| EP | 2 878 794 | A1 | 6/2015 |
| JP | 2008-138067 | A | 6/2008 |
| JP | 2008-138607 | A | 6/2008 |
| JP | 2008-144720 | A | 6/2008 |
| JP | 2011-169152 | A | 9/2011 |
| JP | 2013-241845 | A | 12/2013 |
| JP | 5811280 | B2 | 11/2015 |
| WO | 2014/017170 | A1 | 1/2014 |

* cited by examiner

VARIABLE-COMPRESSION-RATIO INTERNAL COMBUSTION ENGINE

CROSS-REFERENCE TO RELATED APPLICATIONS

This application is a U.S. national stage application of International Application No. PCT/IB2018/000343, filed on Mar. 6, 2018.

BACKGROUND

Technical Field

The present invention relates to a variable-compression-ratio internal combustion engine.

Background Information

For example, International Publication 2014/017170 (Patent Document 1) discloses an internal combustion engine that has a variable compression ratio mechanism that changes the compression ratio in accordance with the rotational position of a control shaft.

In this Patent Document 1, an actuator that rotationally drives the control shaft of the variable compression ratio mechanism is fixed on a side wall of an upper oil pan assembly attached below a cylinder block.

However, combustion load acts on the actuator via the control shaft. Therefore, it is necessary to increase the rigidity of the side wall of the upper oil pan assembly in order to support and fix the actuator. That is, the weight of the upper oil pan assembly is increased in order to increase the rigidity.

Therefore, there is the problem that the weight of the internal combustion engine as a whole increases, while fuel consumption and engine output decrease relatively and the cost increases.

SUMMARY

In the variable-compression-ratio internal combustion engine of the present invention, an actuator that rotationally drives a control shaft of a multi-link piston crank mechanism is fixed to a bearing member that rotatably supports the crankshaft. At least a portion of the actuator is fixed to the bearing member in a state of being positioned on the outside of a case member forming a crank chamber.

By means of the present invention it is possible to fix the actuator without increasing the rigidity of the case member.

BRIEF DESCRIPTION OF THE DRAWINGS

Referring now to the attached drawings which form a part of this original disclosure.

DETAILED DESCRIPTION OF EMBODIMENTS

One embodiment of the present invention will be described in detail below based on the drawings.

Figure 1:
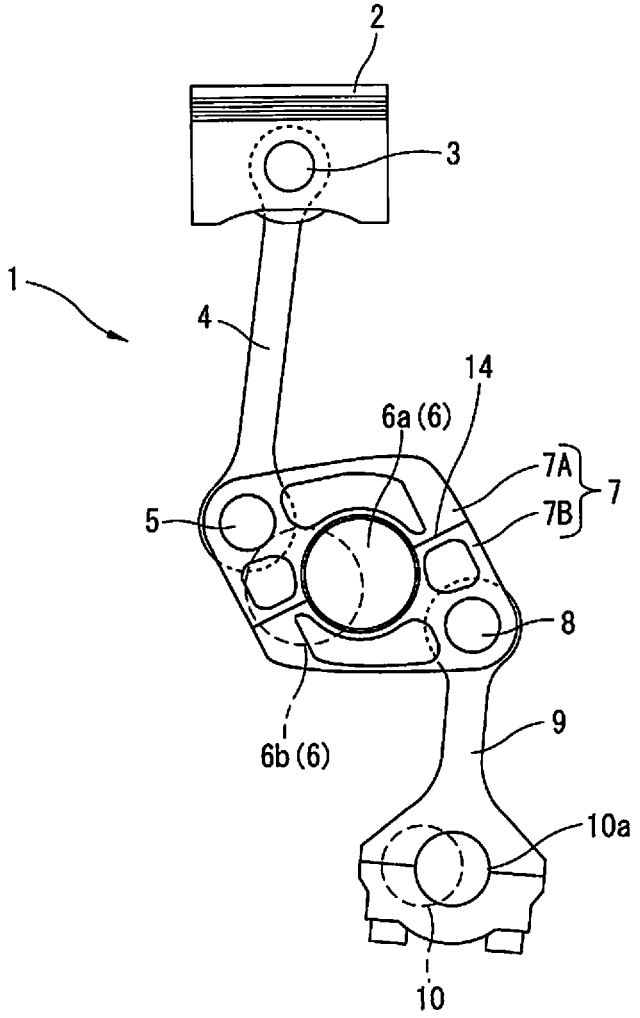
FIG. 1 is an explanatory view schematically illustrating constituent elements of a variable compression ratio mechanism included in a variable-compression-ratio internal combustion engine according to the present invention.

FIG. 1 is an explanatory view schematically illustrating constituent elements of a variable compression ratio mechanism 1 included in a variable-compression-ratio internal combustion engine according to the present invention.

The variable-compression-ratio internal combustion engine constitutes an engine unit together with, for example, a transmission (not shown), and is supported by a vehicle body, which is not shown, via a plurality of support members such as an engine mount and a torque rod, which are also not shown.

The variable compression ratio mechanism 1 comprises an upper link 4, one end of which is connected to a piston 2 via a piston pin 3, a lower link 7 that is connected to the other end of the upper link 4 via an upper pin (first connecting pin) 5 and that is connected to a crank pin 6*a* of a crankshaft 6, a control link 9, one end of which is connected to the lower link 7 via a control pin (second connecting pin) 8, and a control shaft 10 that has an eccentric shaft portion 10*a* and to which the other end of the control link 9 is connected.

That is, the variable compression ratio mechanism 1 utilizes a multi-link piston crank mechanism in which the piston 2 and the crank pin 6*a* of the crankshaft 6 are connected by means of a plurality of links.

One end of the upper link 4 is rotatably attached to the piston pin 3, and the other end is rotatably connected to one end side of the lower link 7 by means of the upper pin 5.

The crankshaft 6 is made of a metal material and includes a plurality of crank pins 6*a* and crank journals 6*b*. In the crankshaft 6, the crank journal 6*b* is rotatably supported by a first bearing portion 11 described further below. The crank pin 6*a* is decentered from the crank journal 6*b* by a prescribed amount, and the lower link 7 is rotatably connected thereto.

One end of the control link 9 is rotatably connected to the other end side of the lower link 7 by means of the control pin 8, and the other end is attached to an eccentric shaft portion 10*a* of the control shaft 10. The upper pin 5 and the control pin 8 are press-fitted to the lower link 7.

The control shaft 10 is arranged parallel with the crankshaft 6 and is rotatably supported by a second bearing portion 14. The control shaft 10 is positioned below the crankshaft 6.

The variable compression ratio mechanism 1 rotates the control shaft 10 and varies the position of the eccentric shaft portion 10*a*, to thereby swing the control link 9, which restricts the degree of freedom of the lower link 7. Then, the variable compression ratio mechanism 1 swings the control link 9 to thereby change the position of the piston 2 at the top dead center and change the mechanical compression ratio of the internal combustion engine. The control shaft 10 is rotationally driven by an actuator 30 described further below.

Figure 2:
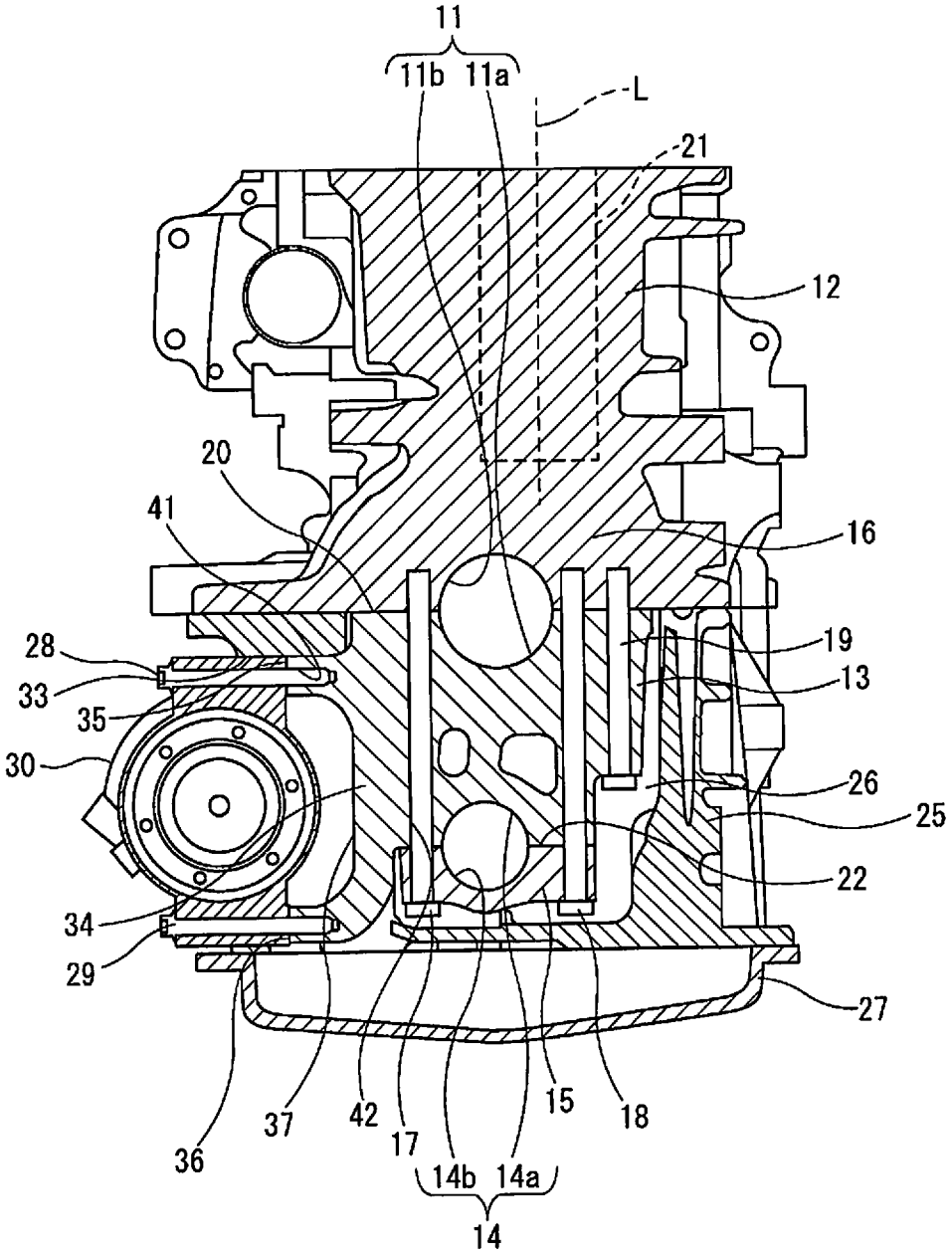
FIG. 2 is a cross-sectional view schematically illustrating a bearing structure of a crankshaft of the variable-compression-ratio internal combustion engine according to the present invention.

FIG. 2 is a cross-sectional view schematically illustrating a bearing structure of the crankshaft 6.

The first bearing portion 11 serving as a crankshaft bearing portion is composed of a cylinder block 12 made of a metal material and a main bearing cap 13 serving as the bearing member (first bearing member).

The second bearing portion 14 serving as the control shaft is composed of the main bearing cap 13 and a control shaft bearing cap 15 serving as a second bearing member.

The main bearing cap 13 is made of a metal material, and is attached to the lower portion of the cylinder block 12, specifically the lower portion of a bulkhead 16 between the cylinders, by means of three bolts, 17, 18, 19.

The main bearing cap 13 is a plate-shaped member having a prescribed thickness in the direction of the cylinder row (direction perpendicular to the plane of FIG. 2).

The control shaft bearing cap 15 is made of metal and is attached to the lower portion of the main bearing cap 13.

The control shaft bearing cap 15 is a plate-shaped member having a prescribed thickness in the direction of the cylinder row (direction perpendicular to the plane of FIG. 2).

Two bolts 17, 18 from among the three bolts 17-19 extend through both the main bearing cap 13 and the control shaft bearing cap 15. These two bolts 17, 18 fix the main bearing cap 13 and the control shaft bearing cap 15 to the cylinder block 12 in a so-called joint-fastening mariner. As shown in FIG. 2, these two bolts 17, 18 extend through both sides of the first bearing portion 11 and the second bearing portion 14, which are circular openings.

A joining surface 20 between the main bearing cap 13 and the bulkhead 16 in the present embodiment is a plane that is orthogonal to the central axis L of a cylinder 21. A joining surface 22 between the main bearing cap 13 and the control shaft bearing cap 15 in the present embodiment is a plane that is orthogonal to the central axis L of cylinder 21. That is, the joining surface 20 is parallel to the joining surface 22.

The bolts 17-19 may be normal bolts with heads, or stud bolts that are used in combination with nuts.

In addition, an upper oil pan assembly 25 serving as a case member is attached to the cylinder block 12.

The upper oil pan assembly 25 forms a crank chamber 26 inside, together with the cylinder block 12. The variable compression ratio mechanism 1, the main bearing cap 13, the control shaft bearing cap 15, and the like are housed in the crank chamber 26.

A lower oil pan assembly 27 is attached to the lower portion of the upper oil pan assembly 25.

An actuator 30 is fixed to the main bearing cap 13 by means of bolts 28, 29.

The bolts 28, 29 may be normal bolts with heads, or stud bolts that are used in combination with nuts.

Figure 3:
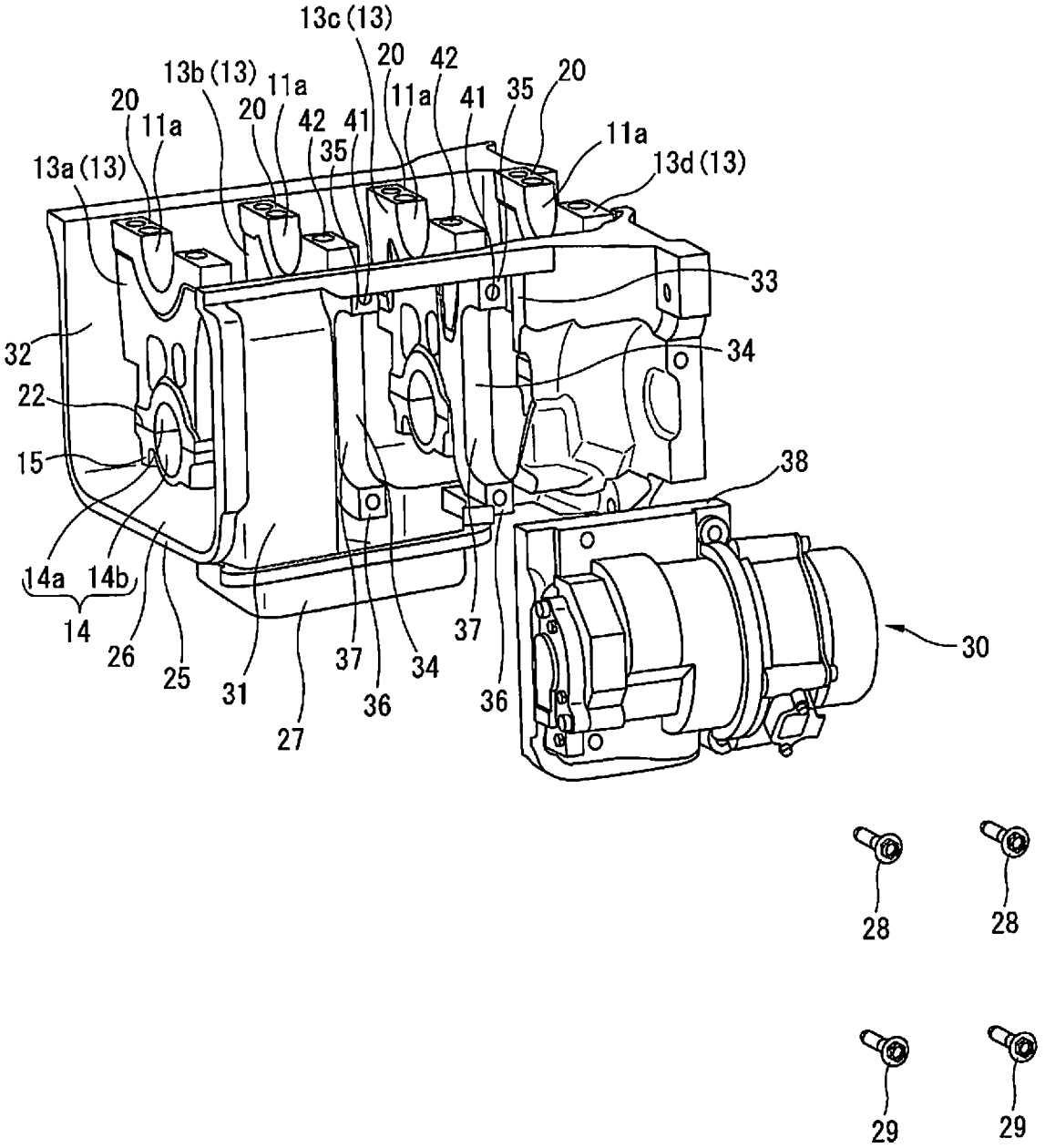
FIG. 3 is an exploded perspective view of a lower portion of the variable-compression-ratio internal combustion engine according to the present invention.
Figure 4:
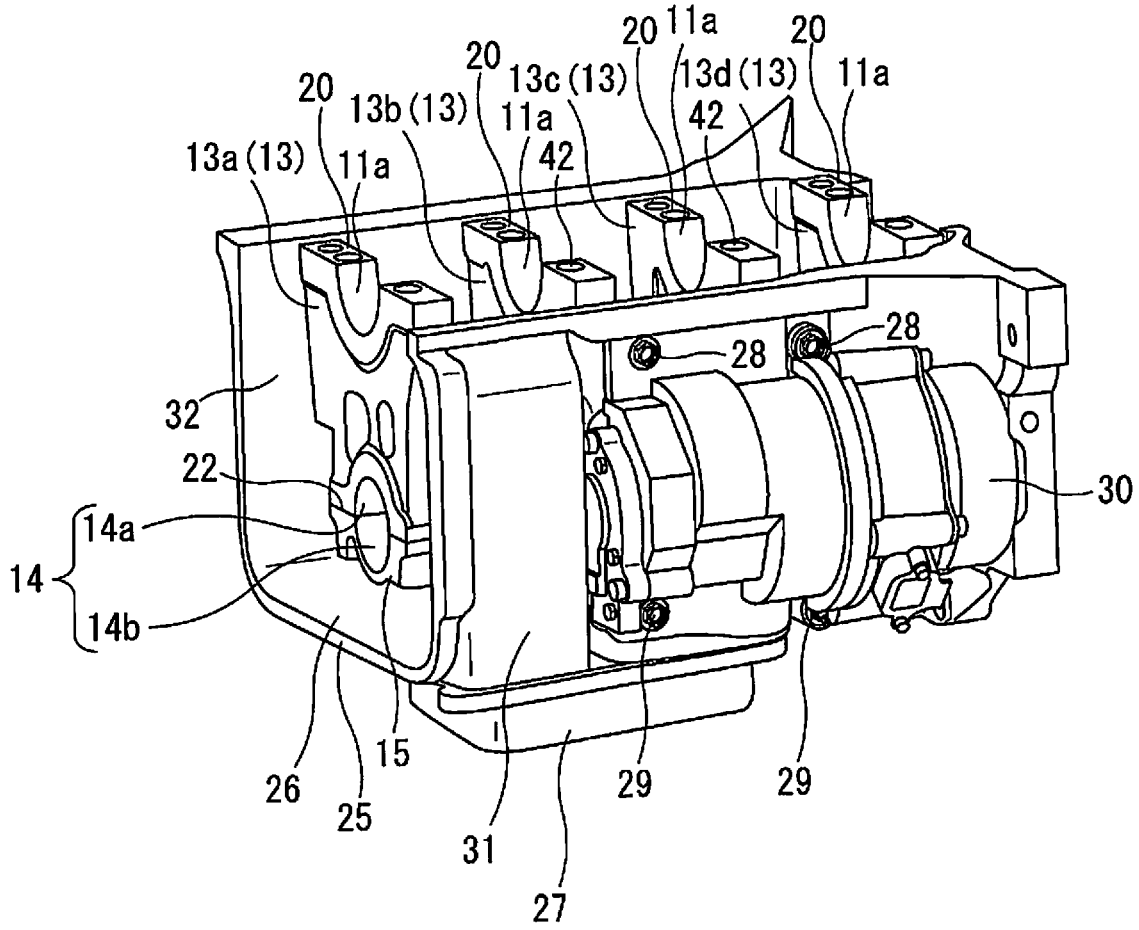
FIG. 4 is a perspective view of the lower portion of the variable-compression-ratio internal combustion engine according to the present invention.
Figure 5:
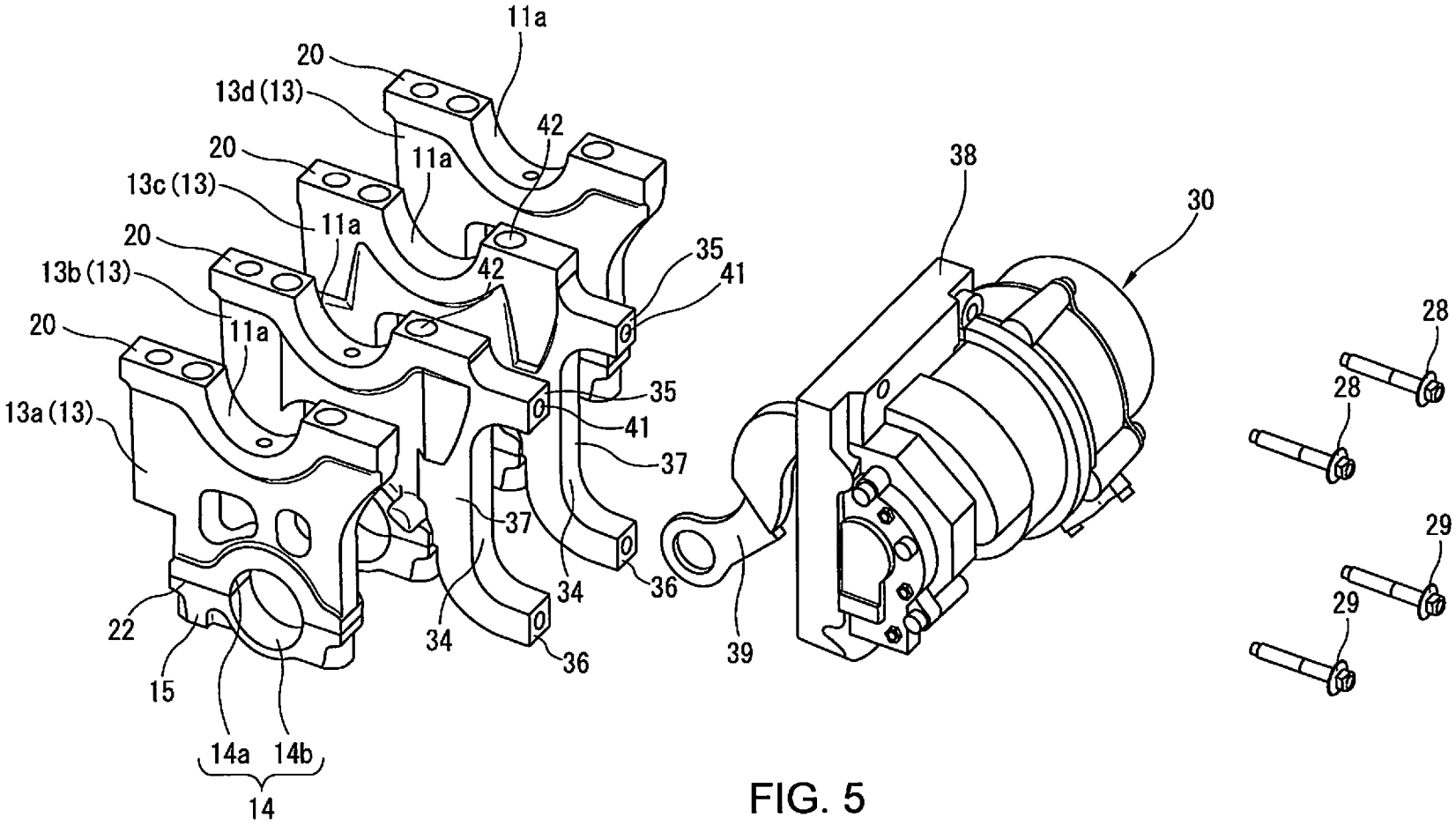
FIG. 5 is a perspective view schematically illustrating an actuator and a main bearing cap.
Figure 6:
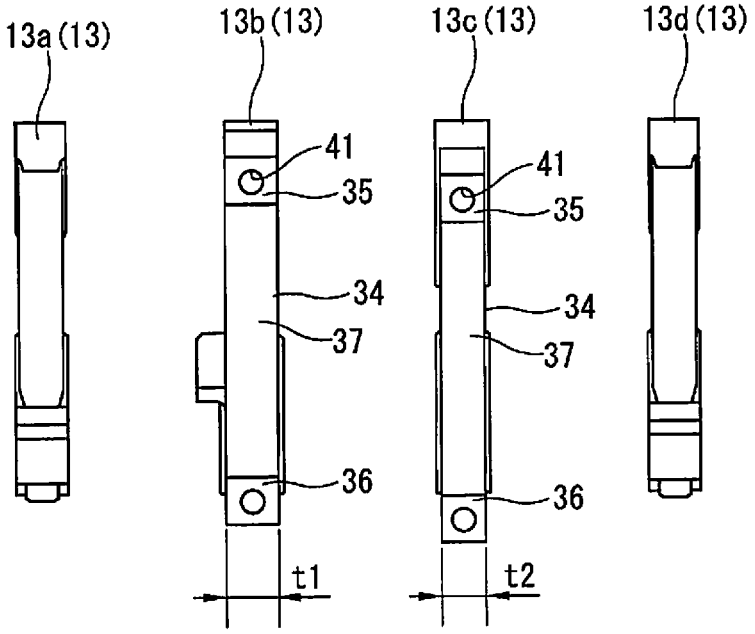
FIG. 6 is a side view of the main bearing cap.

The attachment structure of the actuator 30 will be further described with reference to FIGS. 3 to 6. FIG. 3 is an exploded perspective view of the lower portion of the variable-compression-ratio internal combustion engine. FIG. 4 is a perspective view of the lower portion of the variable compression ratio internal combustion. FIG. 5 is a perspective view schematically illustrating the actuator 30 and the main bearing cap 13. FIG. 6 is a side view of the plurality of main bearing caps 13 attached to the cylinder block 12.

FIGS. 3-6 illustrate examples in which the present invention is applied to a multi-cylinder variable-compression-ratio internal combustion engine.

As shown in FIG. 3, the upper oil pan assembly 25 has a pair of side walls 31, 32 facing each other. A rectangular opening 33 is formed on one side wall 31 from among the pair of side walls 31, 32. That is, the upper oil pan assembly 25 has a rectangular opening 33 on the side wall 31 that extends along the cylinder row direction.

Four locations of the crankshaft 6 of the present embodiment in the cylinder row direction are rotatably supported by the first bearing portion 11. That is, the cylinder block 12 has four bulkheads 16. In addition, the variable-compression-ratio internal combustion engine has four (a plurality of) main bearing caps 13*a*, 13*b*, 13*c*, 13*d* corresponding to the four bulkheads 16.

The main bearing cap 13 has a main bearing cap-side first bearing portion 11*a* formed on an upper end surface thereof on the cylinder block side, and a main bearing cap-side second bearing portion 14*a* on a lower end surface on the opposite side (lower side).

That is, the first bearing portion 11 is composed of the main bearing cap-side first bearing portion 11*a*, and a bulkhead-side first bearing portion 11*b* formed on the bulkhead 16.

The second bearing portion 14 is composed of the main bearing cap-side second bearing portion 14*a*, and a control shaft bearing cap-side second bearing portion 14*b* formed on the control shaft bearing cap 15.

Of the four (plurality of) main bearing caps 13, the actuator 30 is attached to the main bearing caps 13*b*, 13*c* positioned at a central portion in the cylinder row direction.

As shown in FIGS. 2, 3, 5, and 6, the main bearing caps 13*b*, 13*c* to which the actuator 30 is attached have metal actuator attachment portions 34, to which the actuator 30 is attached on one of the sides (one side).

The actuator attachment portions 34, for example, are cast integrally with the main bearing caps 13*b*, 13*c*.

The actuator attachment portions 34 constitute one of the side (one side) surfaces of each of the main bearing caps 13*b*, 13*c*.

The actuator attachment portion 34 has first and second mounting surfaces 35, 36, which are in contact with the actuator 30 and are spaced apart from each other, and a groove 37 positioned between the first mounting surface 35 and the second mounting surface 36. The groove 37 separates the first mounting surface 35 and the second mounting surface 36.

The actuator attachment portion 34 is formed such that the first and second mounting surfaces 35, 36 are positioned on the same plane, and are at the same position in the engine width direction (left-right direction in FIG. 2).

That first mounting surface 35 is positioned closer to the cylinder block side than the second mounting surface 36. That is, the first mounting surface 35 and the second mounting surface 36 are formed so as to be separated from each other in the vertical direction.

The actuator attachment portion 34 is formed such that the second mounting surface 36 is positioned below the control shaft bearing cap 15 in the vertical direction.

The groove 37 is a recessed portion having a prescribed width along the vertical direction, obtained by hollowing out the portion between the first mounting surface 35 and the second mounting surface 36.

The groove 37 is hollowed out so as to be recessed toward the crank chamber side and has a U-shaped cross section.

It is thereby possible to prevent the actuator 30 from coming in contact with portions other than the first and second mounting surfaces 35, 36 of the bearing member, when attaching the main bearing caps 13*b*, 13*c* and the actuator 30. In addition, it is possible to increase the design flexibility of the outer shape of the actuator 30.

Then, the groove 37 is formed so as to be capable of housing a portion of the actuator 30.

It is thereby possible to reduce the amount of protrusion of the actuator 30 from the upper oil pan assembly 25, and to downsize the variable-compression-ratio internal combustion engine as a whole.

The groove 37 is continuous with the first mounting surface 35 and the second mounting surface 36 and constitutes one of the sides (one side) of the main bearing cap 13 together with the first mounting surface 35 and the second mounting surface 36.

For example, when the groove 37 becomes deep and the hollowed amount increases, the weight of the actuator attachment portion 34 decreases, but the rigidity and strength also decrease. In addition, for example, when the groove 37 becomes shallow and the hallowed amount decreases, the rigidity and the strength of the main bearing caps 13*b*, 13*c* increase, but there is the risk of vibration (resonance) caused by the weight of the actuator 30.

Therefore, weight reduction and rigidity of the main bearing caps 13*b*, 13*c* are optimized by setting the groove 37 between the first mounting surface 35 and the second mounting surface 36. That is, by optimizing the amount of the actuator attachment portions 34 hollowed out by the groove 37, it is possible to achieve both good strength and vibration characteristics, while securing the rigidity of the main bearing caps 13*b*, 13*c*.

In the present embodiment, the first mounting surface 35 and the second mounting surface 36 are positioned on the same plane, but it is also possible to form actuator attachment portions 34 in which the first mounting surface 35 and the second mounting surface 36 are offset in the engine width direction (left-right direction in FIG. 2).

The actuator 30 is attached to the main bearing caps 13*b*, 13*c* from the opening 33 of the upper oil pan assembly 25.

The actuator 30 has a rectangular fixing part 38 that is fixed to the main bearing caps 13*b*, 13*c*. The fixing part 38 closes the opening 33 of the upper oil pan assembly 25 and is fixed to the first mounting surface 35 and the second mounting surface 36 of the main bearing caps 13*b*, 13*c* by means of four bolts. The outer circumferential surface of the fixing part 38 and the inner circumferential surface of the opening 33 are sealed by means of a sealing material (not shown), such as a gasket.

Accordingly, as shown in FIGS. 2 and 4, the actuator 30 is fixed to the main bearing caps 13*b*, 13*c* in a state in which the portion outside of the fixing part 38 is positioned on the outer side of the upper oil pan assembly 25. That is, at least a portion of the actuator 30 is fixed to the main bearing caps 13*b*, 13*c* in a state in which at least a portion thereof is positioned on the outer side of the upper oil pan assembly 25.

The actuator 30 is a drive unit composed of an electric motor, a decelerator, and the like, and rotationally drives the control shaft 10 by swinging the link member 39 that is connected so as to be orthogonal to the control shaft 10.

As shown in FIG. 5, the link member 39 is connected to the actuator 30.

The link member 39 is driven by the actuator 30, so as to swing in a plane perpendicular to the rotational axis of the control shaft 10 in the engine width direction (left-right direction in FIG. 2). The control shaft 10 rotates due to swinging of the connecting position with the link member 39 caused by the swinging of the link member 39.

The link member 39 is connected to the control shaft 10 between the main bearing caps 13*b*, 13*c*. In other words, the actuator 30 is fixed to the main bearing caps 13*b*, 13*c* positioned on both sides of the link member 39 in the cylinder row direction.

As a result, the variable-compression-ratio internal combustion engine enables the actuator 30 to be firmly supported and fixed to the main bearing caps 13*b*, 13*c* relative to the combustion load acting on the actuator 30 from the control shaft 10 via the link member 39.

In addition, the main bearing caps 13*b*, 13*c* are formed such that the dimension along the cylinder row direction of the actuator attachment portion 34 that is closer to the link member 39 in the cylinder row direction becomes relatively large.

In the variable-compression-ratio internal combustion engine according to the present embodiment, the main bearing cap 13*b* is closer to the link member 39 than the main bearing cap 13*c* in the cylinder row direction. Therefore, as shown in FIG. 6, the variable-compression-ratio internal combustion engine according to the present embodiment is formed such that the dimension of the actuator attachment portion 34 of the main bearing cap 13*b* along the cylinder row direction is larger than the dimension of the actuator attachment portion 34 of the main bearing cap 13*c* along the cylinder row direction.

That is, the variable-compression-ratio internal combustion engine according to the present embodiment is formed such that thickness t1 (for example, t1=24.8 mm) of the actuator attachment portions 34 of the main bearing cap 13*b* along the cylinder row direction is greater than thickness t2 (for example, t2=21 mm) of the actuator attachment portions 34 of the main bearing cap 13*c* along the cylinder row direction.

As a result, the variable-compression-ratio internal combustion engine according to the present embodiment enables the actuator 30 to be firmly supported and fixed to the main bearing cap 13*b* relative to the combustion load acting on the actuator 30 via the link member 39.

When fixing the actuator 30 to the side wall of the oil pan upper assembly 25, it is necessary to increase the rigidity of the side wall of the oil pan upper assembly 25. In this case, the weight of the upper oil pan assembly 25 is increased in order to increase the rigidity. Consequently, there is the problem that the overall weight of the variable-compression-ratio internal combustion engine increases, which may result in a relative increase in fuel consumption and engine output and an increase in cost.

However, in the variable-compression-ratio internal combustion engine of the present embodiment, the actuator 30 is fixed to the main bearing cap 13 in a state in which a portion thereof is positioned on the outer side of the upper oil pan assembly 25.

As a result, in the variable-compression-ratio internal combustion engine of the present embodiment, it is possible to fix the actuator 30 without increasing the rigidity of the upper oil pan assembly 25.

By attaching the actuator 30 directly to the main bearing cap 13, which rotatably supports the crankshaft 6, it is possible to suppress the weight increase of the oil pan upper assembly 25 and to suppress the weight increase of the variable-compression-ratio internal combustion engine.

In addition, by suppressing the weight increase of the variable-compression-ratio internal combustion engine, it is possible to improve the fuel consumption and engine output of the variable-compression-ratio internal combustion engine, and to also reduce the cost of the variable-compression-ratio internal combustion engine.

A bolt hole 41 into which is inserted the bolt 28 for fixing the actuator 30 to the main bearing cap 13 on the first mounting surface 35 may be formed so as to communicate with a bolt hole 42 into which the bolt 17 is inserted.

In addition, the actuator 30 may be fixed to three or more main bearing caps 13.

The invention claimed is:

1. A variable-compression-ratio internal combustion engine comprising a case member that is attached to a lower portion of a cylinder block and that forms a crank chamber together with the cylinder block; a plurality of bearing members that are attached to the lower portion of the cylinder block and that, with the cylinder block, forms a crankshaft bearing portion that rotatably supports a crankshaft therebetween; a multi-link piston crank mechanism that is positioned inside the crank chamber and that changes a top dead center position of a piston in accordance with a rotational position of a control shaft to thereby change a compression ratio; and an actuator that is fixed to the plurality of the bearing members in a state in which at least a portion thereof is positioned on an outer side of the case member, and that rotationally drives the control shaft of the multi-link piston crank mechanism, the case member having an opening on a side surface along a cylinder row direction, the actuator having a fixing part that closes the opening, and the fixing part being fixed by bolts to the plurality of bearing members from the opening.

2. The variable-compression-ratio internal combustion engine according to claim 1, further comprising a link member that is connected so as to be orthogonal to the control shaft, wherein the actuator rotationally swings the link member to rotationally drive the control shaft positioned parallel with the crankshaft, and is fixed to a pair of the bearing members positioned on both sides of the link member in the cylinder row direction.

3. The variable-compression-ratio internal combustion engine according to claim 1, further comprising a link member that is connected so as to be orthogonal to the control shaft, wherein the actuator rotationally swings the link member to rotationally drive the control shaft positioned parallel with the crankshaft, and the plurality of bearing members to which the actuator is fixed are formed such that a dimension thereof along the cylinder row direction of a portion to which the actuator is attached is larger when closer to the link member in the cylinder row direction.

4. The variable-compression-ratio internal combustion engine according to claim 1, wherein the plurality of bearing members to which the actuator is attached have an actuator attachment portion to which the actuator is attached, and the actuator attachment portions have first and second mounting surfaces that are in contact with the actuator and are spaced apart from each other, and a groove is positioned between the first mounting surface and the second mounting surface and separates the first mounting surface and the second mounting surface.

5. The variable-compression-ratio internal combustion engine according to claim 4, wherein the grooves are formed so as to be capable of housing a portion of the actuator.

6. The variable-compression-ratio internal combustion engine according to claim 4, wherein the actuator attachment portions are cast integrally with the bearing members.

7. The variable-compression-ratio internal combustion engine according to claim 5, wherein the actuator attachment portions are cast integrally with the bearing members.

8. The variable-compression-ratio internal combustion engine according to claim 2, wherein the plurality of bearing members to which the actuator is attached have an actuator attachment portion to which the actuator is attached, and the actuator attachment portions have first and second mounting surfaces that are in contact with the actuator and are spaced apart from each other, and a groove is positioned between the first mounting surface and the second mounting surface and separates the first mounting surface and the second mounting surface.

9. The variable-compression-ratio internal combustion engine according to claim 8, wherein the grooves are formed so as to be capable of housing a portion of the actuator.

10. The variable-compression-ratio internal combustion engine according to claim 8, wherein the actuator attachment portions are cast integrally with the bearing members.

11. The variable-compression-ratio internal combustion engine according to claim 9, wherein the actuator attachment portions are cast integrally with the bearing members.

12. The variable-compression-ratio internal combustion engine according to claim 3, wherein the plurality of bearing members to which the actuator is attached have an actuator attachment portion to which the actuator is attached, and the actuator attachment portions have first and second mounting surfaces that are in contact with the actuator and are spaced apart from each other, and a groove is positioned between the first mounting surface and the second mounting surface and separates the first mounting surface and the second mounting surface.

13. The variable-compression-ratio internal combustion engine according to claim 12, wherein the grooves are formed so as to be capable of housing a portion of the actuator.

14. The variable-compression-ratio internal combustion engine according to claim 12, wherein the actuator attachment portions are cast integrally with the bearing members.

15. The variable-compression-ratio internal combustion engine according to claim 13, wherein the actuator attachment portions are cast integrally with the bearing members.

* * * * *